United States Patent [19]

Clark

[11] 3,936,635

[45] Feb. 3, 1976

[54] CORONA GENERATING DEVICE

[75] Inventor: Peter Frederick Clark, Ware, England

[73] Assignee: Xerox Corporation, Stamford, Conn.

[22] Filed: June 11, 1974

[21] Appl. No.: 478,182

[30] Foreign Application Priority Data

Dec. 21, 1973 United Kingdom ..... 59526/73

[52] U.S. Cl. ..... 250/325; 317/262 A

[51] Int. Cl.[2] ..... H01T 19/00

[58] Field of Search ..... 250/326, 325, 324; 317/262 A

[56] References Cited

UNITED STATES PATENTS

| | | | |
|---|---|---|---|
| 2,836,725 | 5/1958 | Vyverberg | 250/326 |
| 3,566,223 | 2/1971 | Salger | 250/326 |
| 3,675,096 | 7/1972 | Kiess | 250/325 |

*Primary Examiner*—Archie R. Borchelt
*Assistant Examiner*—T. N. Grigsby

[57] ABSTRACT

A corona generating device comprising a coronode, a metal screen having a shield defined by upturned integral flanges mounted thereon and a support member of insulating material.

10 Claims, 7 Drawing Figures

CORONA GENERATING DEVICE

BACKGROUND OF THE INVENTION

This invention relates to electrostatography. More particularly, this invention relates to corona generating devices for applying electrostatic charge onto a suitable surface.

The basic electrostatographic process is disclosed in U.S. Pat. No. 2,297,691. In this process an electrostatographic plate comprising a photoconductive insulating material on a conductive backing is given a uniform electric charge over its surface and is then exposed to the subject matter to be reproduced usually by conventional projection techniques. This exposure discharges the plate areas in accordance with the radiation intensity which reaches them and thereby creates an electrostatic latent image on or in the plate coating which may then be developed into visible form by applying a developer material, e.g., a powder, to the plate using any one of a number of development techniques generally known and used in the art. The developer material electrostatically clings to the plate in a visual pattern corresponding to the electrostatic image. Thereafter the developed image is usually transferred from the plate to a support material such as paper to which it may be fixed by any suitable means thereby forming a permanent print.

Instead of being developed by means of a powder, the electrostatic latent image may be developed using liquid development techniques such as those described in U.S. Pat. No. 3,084,043, for example.

The charging of the electrostatographic plate in preparation for the exposure step can be accomplished by means of a corona generating device whereby electrostatic charge is applied to the electrostatographic plate to raise it to a potential of approximately 500 to 600 volts. One form of corona generating device for this purpose is disclosed in the U.S. Pat. No. 2,777,957 wherein a plurality of parallel wires are connected in series to a high voltage source and are supported in a conductive shield that is arranged in closely spaced relation to the surface to be charged. When the wires are energized, corona is generated along the surface of the wires and ions are caused to be deposited on the adjacent photoconductive surface. Suitable means are usually provided to effect relative movement of the surface to be charged and the corona generating device. Such a device may have a single corona wire.

It has heretofore been established that consistent high quality reproductions can best be obtained when uniform potential is applied to the electrostatographic plate in preparation of the plate for exposure step. If the electrostatographic plate is not charged to a sufficient potential, the electrostatic latent image obtained upon exposure will be relatively weak and the resulting deposition of developer material thereon will be correspondingly small. If, however, the electrostatographic plate is overcharged, the converse will occur and if overcharged sufficiently the photoconductive layer of the electrostatographic plate can be permanently damaged. The charging of an electrostatographic plate to a uniform potential is generally loosely referred to in the art as uniformly charging the plate and for convenience this expression is used hereinafter to refer to charging such a plate to a uniform potential.

Since the contrast value, comparable to the contrast values obtained from silver halide papers, of the electrostatic latent image may be related directly to the potential charge on the electrostatographic plate before exposure, it is apparent that if the plate is not uniformly charged over its entire area, the contrast value of the electrostatic latent image obtained upon exposure will vary in different areas on the plate, and an uneven or mottled effect will be visible on the image when developed.

A more uniform and controlled charge can be obtained by placing a biased wire screen between the corona wires and the electrostatographic plate. This screen, which may be insulated from or electrically connected to the shield, permits energizing the corona wires to a potential well above the corona threshold potential thereof without causing damage to the electrostatographic plate because the excess of corona current over that required for proper charging of the plate is drained off by the biased screen. This type of corona generating device is referred to in the art as a "scorotron".

While a corona generating device as described above produces a very uniform and controlled charge, a substantial proportion of the corona generated is consumed by the metal shield resulting in relatively high ozone levels. Also, any lack of rigidity of the screen leading to it being distorted will result in uneven charge distribution on the plate.

OBJECTS AND SUMMARY OF THE INVENTION

It is an object of this present invention to alleviate the above difficulties.

To this end, the invention consists in a corona generating device comprising a coronode, a metal screen, a shield defined by upturned integral flanges on said screen and a support member of insulating material, preferably a plastics material.

With this construction the absence of metal opposite the screen reduces the current flowing to the shield and improves the efficiency compared with a device having a channel shaped metal shield. Furthermore constructing the shield elements integrally with the screen improves the rigidity of the latter.

The support member may be a backing element having the free edges of the flanges (shield elements) connected thereto e.g., by being a snap- or force- fit in grooves in the member but preferably this member has a channel shaped cross-section and the shield/screen is supported in the channel. With this arrangement, maximum rigidity of the screen may be achieved and furthermore, the metal shield elements are enclosed thus reducing the potential shock hazard of such devices which have channel-like metal shields electrically connected to the screen.

In a preferred form, the side walls of the channel member are substantially planar and the screen/shield has a substantially rectangular channel cross-section, and the screen is gripped between the plastics side walls with the shield elements fitting snugly against the side walls.

The coronode, which is suitably one or more wires connected between mountings at opposite ends of the device, is preferably arranged between the shield elements but it is anticipated that with reduced efficiency it could be arranged just outside the space encompassed by the shield elements.

As is known in the art, corona emission has associated therewith ionised particles which are propelled towards the electrostatographic plate. It has been found that this movement of ions leads to loss of air from the interior of the generating device. Air also tends to be drawn out by reason of the relative movement of the plate. This leads to air being sucked into the device, usually through the ends thereof and since this incoming air is likely to be dust laden, contamination problems result. Where the shield of the device is metal, it is essential that the shield be kept spaced from the electrostatographic plate, the surface of which is delicate and easily damaged by metal surfaces. The plate however is less easily damaged by plastics materials and a preferred feature of a device according to this invention which has a channel shaped support member is that the free edges of the channel side walls extend beyond the screen and when the device is in use can be arranged close to the electrostatographic plate to reduce air flow and thus contamination. At the same time the chances of the plate being contacted by the metal screen are reduced or eliminated.

It is also important that the coronode which is generally in the form of one or more fine wires stretched between mountings at opposite ends of the device be maintained in taut condition since slackness and kinks in the coronode wires will result in non-uniformity of the charge applied to the electrostatographic plate. In order to ensure that the coronode is maintained in sufficiently taut condition, a device of this invention may incorporate features of the invention disclosed in our copending application Ser. No. 478,208, — filed concurrently with this application and assigned to the same assignee. That application describes and claims a corona generating device including a coronode connected between mountings, at least one of which comprises a fixed member and a movable member, to which the associated end of the coronode is attached, said members interacting through compressible resilient means which act to urge the movable member in the direction of the adjacent end of the device.

The mounting member and the movable member are preferably plastics mouldings and the resilient means may be of metal or plastics and may be formed integrally with one of the members or may be one or more separate elements, e.g., one or preferably a pair of compression springs.

In a preferred form, the mounting member is generally channel-shaped in cross-section with separate resilient means arranged in recesses in the side walls, and the movable member fits between the side walls and has lateral lugs which engage the resilient means.

In order to give the assembly maximum strength while keeping the assembly small, the bridge portion of the mounting channel is advantageously narrower than the side walls to provide a space into which a portion of the movable member to which the end of the coronode is attached extends.

From another aspect, the invention consists in, in or for an electrostatographic reproduction apparatus, a corona generating device as described above.

BRIEF DESCRIPTION OF THE DRAWINGS

In order that the invention may be more readily understood, reference will now be made to the accompanying drawings, in which.

DESCRIPTION OF THE PREFERRED EMBODIMENT

Figure 1:
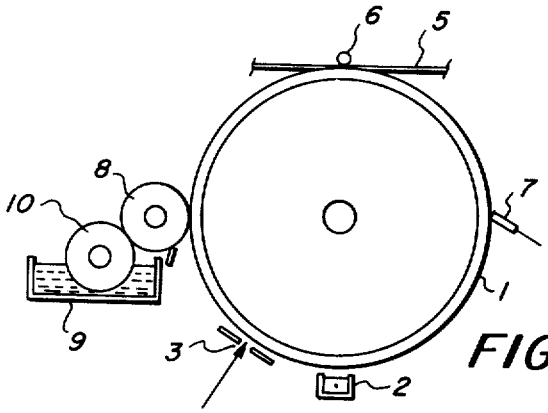
FIG. 1 is a schematic cross-section illustrating the operation of one embodiment of electrostatographic reproduction machine incorporating a corona generating device of this invention.

Referring to the drawings, the general operation of an electrostatographic machine as illustrated will first be described with reference to FIG. 1. A moving photoconductive plate, in this instance having an endless surface constituting the periphery of a drum 1, is first uniformly charged at a charging station 2 by a corona generating device of this invention and the surface then exposed at an exposure station 3 to a light pattern of the image sought to be reproduced thereby to discharge the charge in the area where light strikes the plate surface. The undischarged areas of the surface thus form an electrostatic charge pattern in conformity with the configuration of the original image pattern.

The electrostatic latent image is then developed into visible form by the development system 4 by applying liquid developer material to the plate. Subsequent to the development operation the now visible image is transferred from the plate to a sheet of final support material 5, such as paper of the like, thereby to form a permanent print, at a transfer station in accordance with the present invention schematically illustrated at 6. The paper or the like is fed to the transfer station by means (not shown) programmed to deliver the paper in synchronism with the arrival of the developed image.

Following transfer, residual developer remaining on the plate surface is removed by a cleaning blade 7 and collected for subsequent disposal. The plate is then further discharged or erased to a residual voltage prior to a further electrostatographic cycle.

The development system of the illustrated embodiment employs the techniques described in U.S. Pat. No. 3,084,043 in which the liquid developer is applied to the plate by means of an applicator, in this embodiment in the form of a roll 8 having a peripheral surface comprising lands and valleys such that the liquid developer is contained in the valleys out of contact with the plates, while the surface of the lands are in contact with the plate. In such an arragement the liquid developer is attracted from the valleys to the electrostatic latent image in image configuration. The illustrated embodiment exemplifies a typical example of such an arrangement in which the applicator is a rigid cylindrical member 8 having on its surface a pattern of grooves and ridges which comprise the lands and valleys respectively, the liquid developer being maintained in the valleys below the surface of the lands.

As a plate surface bearing the electrostatic latent image and the applicator are brought into moving contact, the liquid developer is drawn to the plate surface from the valleys of the applicator roll by the charges which form the electrostatic latent image.

The applicator roll 8 is supplied with liquid developer by a developer supply roll 10 the lower portion of which is disposed in a tray 9 containing liquid developer. The surface of the developer supply roll 10 is arranged in liquid transfer relationship with the peripheral surface of the applicator roll 8 which latter is, in operation, arranged in pressure contact with the surface of the drum 1. Means are provided for driving both of the rolls 8 and 9 in synchronism, or substantially so, with the drum 1.

Figure 2:
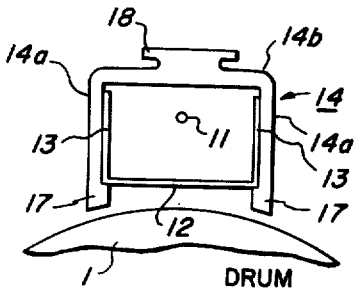
FIG. 2 is a cross-section through an embodiment of corona generating device according to the invention.
Figure 3:
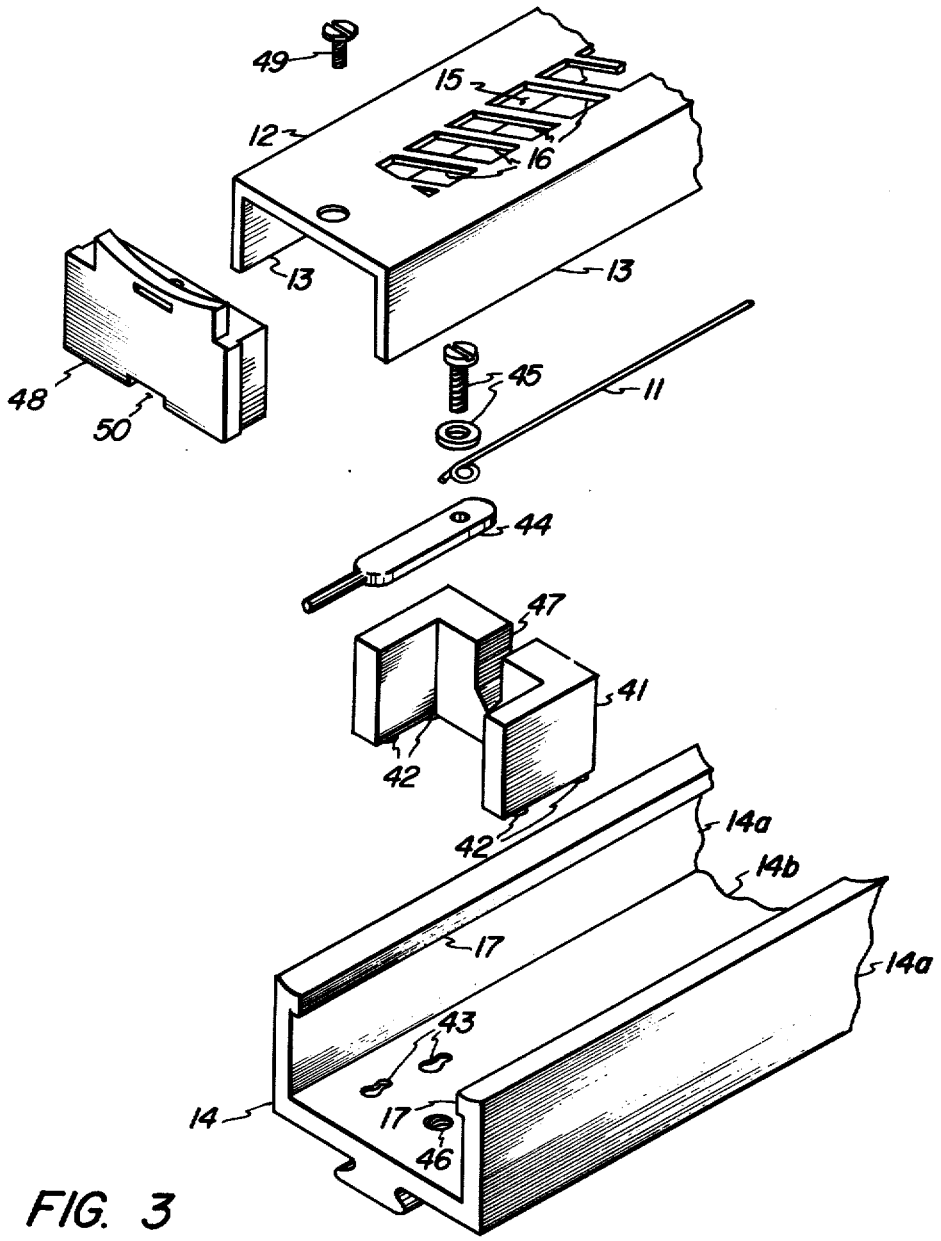
FIG. 3 is an exploded view of one end of the embodiment shown in FIG. 2.
Figure 4:
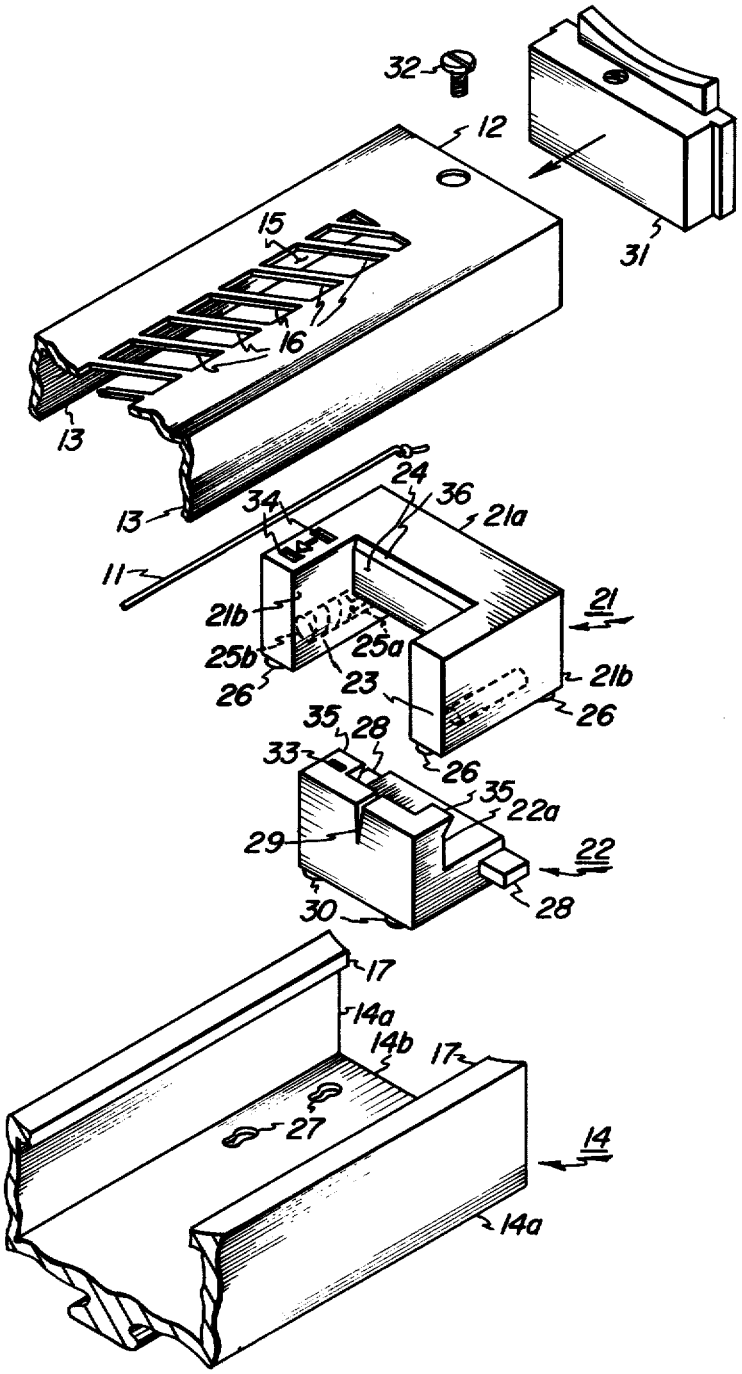
FIG. 4 is an exploded view of the opposite end of the embodiment shown in FIG. 2.

Referring now to FIGS. 2 to 4, the illustrated embodiment of corona generating device according to the invention, comprises a coronode 11, a metal screen 12, a shield 13 defined by upturned, integral flanges along the side edges of the screen, and a support member 14 of plastics material.

The integral screen/shield 12 has a generally flat bottom U-shaped cross section and is formed from a flat strip of metal by stamping or etching the strip to form an aperture 15 spanned by narrow webs 16 (seen in FIGS. 3 and 4), inclined to the length of the screen, and bending up the edges of the strip normal to the screen to form the flanges (shield elements) 13. For a device 12 inches long, the integral screen/shield is suitably formed from a strip of stainless steel 0.006 inch thick and 1.25 inches wide and is stamped or eteched to form an aperture or window 15, 9 inches long and 0.45 inch wide with webs 16 0.008 inch wide and arranged at an angle of 45° to the longitudinal axis of the device, the strip being bent to form flanges 13, 0.375 inch high connected by a screen portion 0.5 inch wide.

The support member 14 is suitably extruded of a plastics material such as polyvinylchloride, polytetrafluoroethylene or nylon. It has a generally rectangular channel-shape in cross-section and the free edges of its side walls **14*a* have upturned lips 17 behind which the screen is retained as shown in FIG. 2. The plastics material is preferably of a rigid grade firmly to support and hold the screen in position with the shield elements or flanges 13 snugly fitting against side walls 14*a*** of the channel member.

With this construction, the channel section of the integral screen/shield gives strength to the screen and reduces distortion and the firm support afforded by the plastics member 14 reduces the possibility of distortion still further.

The back wall **14*b* of the plastics channel member may be provided with suitable fixing means 18 for mounting the device in an electrostatographic machine. As shown in FIG. 2 the lips 17 extend beyond the screen 12 and the device is best arranged with these lips closely adjacent the surface of the electrostatographic plate 1. In this way the small gap between the lips 17** and the plate surface reduces air flow from the device so minimizing contamination carried by the inflow of replacement air. At the same time the lips afford protection to the electrostatographic plate surface from scratching by the metal screen.

The coronode 11 comprises, in the illustrated embodiment, a single stainless steel wire extending between mountings at opposite ends of the device which will be described below and arranged centrally between the shield elements 13. In the specific construction of the device having the dimensions given above, the wire 11 is suitably 0.004 inch in diameter and spaced 0.2 inch behind the screen 12.

Figure 6A:
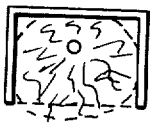
Figure 6B:
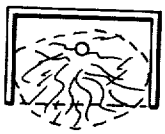

By reason of the back of the device, i.e., the wall **14*b* of member 14, being of non-conductive material the shape of the corona emitted by the device is altered from that exemplified by FIG. 6A for a corotron device having a wholly metal shield of channel shape, to that exemplified by FIG. 6B. Thus less current flows to the shield and the efficiency is improved. When setting up is required, the plastics channel member is made to touch the electrostatographic plate (drum) 1 and then moved away by a sufficient distance to avoid contact caused by eccentrically or other irregularities of the drum during rotation of the drum. When in use the coronode 11** is suitable connected to a high voltage source of say +7000 volts, the screen being biased to a potential of about +700 volts.

The mountings for the ends of the coronode wire 11 will now be described with reference to FIGS. 3 and 4. It is to be understood that any kinks or slackness of the wire will lead to non-uniform charging of the electrostatographic plate, slackness causing non-uniform spacing of the wire from the plate surface and also increasing the chances of vibration being set up in the wire while it is operating. In order to alleviate the problem of non-uniform charging due to these causes, one end mounting for the coronode wire 11 (the one shown in FIG. 4) is constructed to tension the wire.

The mounting shown in FIG. 4 and which forms the subject of our copending patent application Ser. No. 478,208, noted hereinbefore, comprises a fixed member 21 and a movable member 22 to which the associated end of the coronode wire 11 is attached. The two members 21 and 22 interact through compressible resilient means, compression springs 23 being shown, which act to urge the movable member 22 in the direction of the adjacent end of the device, i.e., outwardly.

The member 21 is generally channel-shaped in cross-section with the bridge portion **21*a* connecting the side walls 21*b* being narrower than the latter to form a "cut-out" or space 24 at the inboard end of the member. The compression springs 23 are mounted in recesses comprising grooves 25*a* extending from the outboard ends of the side wall 21*b* and terminating in bores 25*b* adjacent the inboard ends of the wide walls; the bores 25*b* are no longer than and preferably slightly shorter than the springs 23 when fully compressed and serve to hold the springs 23** against lateral movement.

The mounting member 21 is secured to the plastics channel member 14 by four lugs 26 with enlarged heads which engage in corresponding keyhold slots 27 in the back wall **14*b* of the member 14**.

The movable member 22 is slidably mounted between the side walls **21*b* of the mounting member 21 and is provided with lateral lugs 28 which engage in the grooves 25*a* and act against the outbound ends of the springs 23. The member 22 is provided with an upstanding portion 22*a* at its inboard end which fits into the space 24 and has attachment means, in the form of a V-slot 29, for the end of the coronode wire 11. The member 22 is thus generally L-shaped in longitudinal section with the lugs 28 on one limb and the attachment means 29 on the other limb. Frictional forces, as member 22 slides over the back 14*b* of the member 14, are kept to a minimum by the provision on member 22 of pimple-like feet 30**.

Preferably the members 21 and 22 are plastics moldings (they may be molded for example of a polycarbonate or an acrylic material), and good electrical insulation of the coronode from the screen 12 and shield 13 and also, where they are of metal, the springs 23, is ensured. An end piece 31 which is also a plastics molding, is secured in position by a screw 32 fixed through the screen 12.

The end of the coronode wire 11 is secured to the movable attachment member 22 of the mounting by knotting or crimping the end of the wire, as shown for example, and pushing it into the V-slot 29. The degree of tension applied to the wire 11 is indicated by the position of a member 33 on the member 22 relation to the maximum and minimum tension markers 34 on the member 21. These markers are suitably defined by indentations in the plastics moldings. The compression springs 23 counteract any "creep" or stretching of the coronode wire and unlike tension springs they cannot be overstretched during assembly or use.

Figure 5:
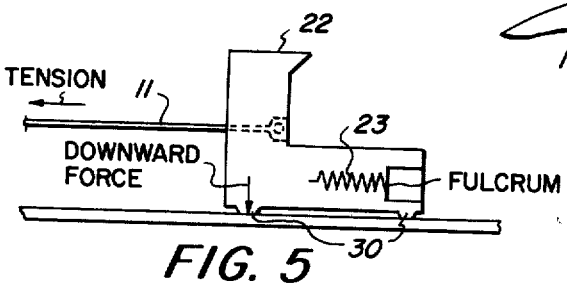
FIG. 5 is a side view of the movable member of the mounting shown in FIG. 4 illustrating the forces applied thereto when in use, and FIGS. 6A and 6B schematically illustrate the way in which the shape of the corona emitted by the embodiment illustrated compares with that of a scorotron having a channel-shaped metal shield.

It will be noted that the design of the resilient mounting assembly described above ensures that a high degree of positional accuracy of the coronode wire is maintained as will be understood if reference is made to FIG. 5. The lugs 28 on attachment member 22 are aligned by their engagement in the grooves 25*a* and the fulcrum between the lugs 28 and springs 23 is so arranged that the inboard feet 30 of member 22 are urged firmly against the back wall 14*b* of the member 14.

The resilient mounting may be assembled with ease. The springs 23 are dropped into the recesses 25 in the member 21 and the member 22 is pushed into position, being tilted during this operation so as to insert the portion 22*a* beyond the bridge piece 21*a* of member 21, the grooves 25*a* being suitably enlarged adjacent their outboard ends for this purpose. (The portion 22*a* of member 22 is provided with lip portions 35 which engage behind a bevelled edge 36 of the bridge portion 21*a* of the member 21 due to the members being urged together by the springs 23 in the absence of the tensioning effect of the coronode wire 11. Thus, the moldings 21 and 22 are so shaped that due to the spring pressure the assembly does not fall apart). The assembly is then pushed into the end of the extruded channel member 14 and the coronode wire 11 is knotted or crimped and inserted in the V-slot 29. Finally the screen is secured in position being held by the end piece 31 to which it is connected engaging behind the lips 17 of the channel member 14. (It will be understood that during assembly, the mounting at the other end of the device will also be fitted in position as will become apparent from the description thereof given hereinbelow). Since the elements of the mounting assembly do not fall apart when removed from the extruded channel member 14, the mounting assembly may be removed for replacement of the coronode 11 without fear of the springs 23 becoming detached and perhaps lost. Also, it is to be noted that disassembly is facilitated by the end piece 31 which serves as a handle for the removal of the screen/-shield 12, 13.

Referring to FIG. 3, the coronode mounting at the opposite end of the above described device is also of plastic material. A plastic molding 41 which is generally channel-shaped in horizontal cross-section is secured to the back wall 14*b* of the member 14 in like manner to the member 21, i.e., by means of headed lugs 42 engaging in keyhold slots 43 in the back wall 14*b*. The end of the coronode wire 11 is looped and secured with a metal connector 44 to the back wall 14*b* of member 14 by a screw 45 which enters a tapped hole 46 in wall 14*b*. The coronode wire passes through a slot 47 in the member 41 which serves to position the coronode wire 11 at that end. A plastics end molding 48 like the molding 31 is secured to the screen/shield by a screw 49 and engages behind the lips 17 of member 14. A slot 50 in this end piece 48 is provided through which the connector 44 extends. It will be understood that during assembly of the device illustrated, this mounting is best secured in position with the coronode wire 11 attached thereto before the resilient mounting at the other end of the device is placed in position and has the other end of the coronode wire 11 attached thereto. The end pieces 31, 48 and the screen/shield are then assembled.

It will be noted that at both ends of the device the coronode 11 is electrically well insulated from the screen/shield and where possible air gaps are filled with plastic material to reduce the possibility of arcing. While a particular embodiment has been described above, it will be realized that various modifications may be made to the specific details referred to herein without departing from the scope of the invention as defined in the appended claims. For example, while the screen/shield of the illustrated embodiment is formed from sheet metal, it could be formed by bending to shape a wire mesh of suitable dimensions. Or the aperture 15 of the screen may be stamped or etched with a plurality of small apertures, for example each aperture being diamond shaped, separated by narrow webs. In another form, the aperture 15 may extend towards the edges of the strip in order that the bending up of the strip normal to the screen to form the flanges (shield elements) 13 takes place on the physically weaker area created by the aperture 15, thus facilitating bending without distortion of the screen/shield.

What is claimed is:

1. A corona generating device comprising a coronode, a metal screen, a shield defined by upturned integral flanges on said screen, and a support member of insulating material, the support member having a channel-shaped cross section, the shield/screen being supported in the channel and retained in the channel-shaped support member behind lips along the free edges of the channel side walls.

2. A device as claimed in claim 1, wherein the coronode is connected between mountings of plastics material at opposite ends of the device.

3. A device as claimed in claim 2, wherein the coronode comprises one or more wires arranged between the shield elements.

4. A device as claimed in claim 1 including a coronode connected between mountings, at least one of which comprises a fixed member and a movable member, to which the associated end of the coronode is attached, said members interacting through compressible resilient means which act to urge the movable member in the direction of the adjacent end of the device.

5. A device as claimed in claim 4, wherein the resilient means comprises compression springs.

6. Apparatus as claimed in claim 4, wherein the fixed and movable members of the mounting assembly are plastics mouldings.

7. A device as claimed in claim 6, including a coronode mounting comprising a plastics moulding having a slot or aperture through which the coronode passes and is secured outwardly thereof to the back wall of the channel-shaped support member.

8. A device as claimed in claim 7 including moulded plastic end pieces to which the screen/shield is secured and which engage behind said lips of the channel-shaped support member.

9. A corona generating device comprising a coronode, a metal screen, a shield defined by upturned integral flanges on said screen, a support member of insulating material, said support member having a channel-shaped cross section, the shield/screen being supported in the channel, the side walls of the channel-shaped support member being substantially planar and the screen/shield having a substantially flat bottomed U-shaped cross section, the screen being held between said side walls with the shield elements fitting against the side walls, a coronode connected between mountings, at least one of which comprises a fixed member and a movable member to which the associated end of the coronode is attached, said fixed and movable members interacting through compressible resilient means which act to urge the movable member in the direction of the adjacent end of the device, wherein the fixed member is generally channel-shaped in cross section, the resilient means being arranged in recesses in said side walls and said movable member has laterally extending lugs which engage the resilient means.

10. A device as claimed in claim 9, wherein the base portion of the channel-shaped member is narrower at its end remote from the adjacent end of the device and the movable member has a portion to which the end of the coronode is attached extending into the space so provided.

* * * * *